US011512706B2

(12) United States Patent
Miyata et al.

(10) Patent No.: US 11,512,706 B2
(45) Date of Patent: Nov. 29, 2022

(54) GEARED COMPRESSOR AND METHOD OF DESIGNING GEARED COMPRESSOR

(71) Applicant: MITSUBISHI HEAVY INDUSTRIES COMPRESSOR CORPORATION, Tokyo (JP)

(72) Inventors: Hiroyuki Miyata, Hiroshima (JP); Masahiro Kobayashi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/647,643

(22) Filed: Jan. 11, 2022

(65) Prior Publication Data

US 2022/0243736 A1 Aug. 4, 2022

(30) Foreign Application Priority Data

Feb. 1, 2021 (JP) ..... JP2021-014123

(51) Int. Cl.
*F04D 25/06* (2006.01)
*F04D 25/16* (2006.01)
*F04D 17/12* (2006.01)

(52) U.S. Cl.
CPC ..... *F04D 25/163* (2013.01); *F04D 17/12* (2013.01); *F04D 25/06* (2013.01)

(58) Field of Classification Search
None
See application file for complete search history.

(56) References Cited

U.S. PATENT DOCUMENTS 5,154,571 A * 10/1992 Prumper ..... F04D 25/02 74/462
5,309,778 A * 5/1994 Antonov ..... B60K 6/26 74/15.86
6,290,622 B1 * 9/2001 Murray ..... F03G 3/00 74/61

(Continued)

FOREIGN PATENT DOCUMENTS

DE 3707992 A1 * 9/1988
EP 1067291 B1 7/2004

(Continued)

OTHER PUBLICATIONS

English Translation of Abstract for corresponding European Publication No. 1,067,291 B1, dated Jul. 7, 2004 (1 page).

*Primary Examiner* — Michael Lebentritt
(74) *Attorney, Agent, or Firm* — Osha Bergman Watanabe & Burton LLP

(57) ABSTRACT

A geared compressor includes a plurality of compression units and a compression-unit-driving mechanism which drives the plurality of compression units. The compression-unit-driving mechanism includes a plurality of driven gears which are provided in respective rotation shafts of the plurality of compression units and a plurality of large-diameter gears which are directly or indirectly driven by a drive source and have outer diameters larger than those of the plurality of driven gears. The plurality of large-diameter gears is arranged side by side in a horizontal direction and each of the plurality of large-diameter gears meshes with two or more of the plurality of driven gears.

7 Claims, 6 Drawing Sheets

(56) References Cited

U.S. PATENT DOCUMENTS

| | | | | |
|---|---|---|---|---|
| 7,490,594 | B2 * | 2/2009 | Van Dyne | F02B 39/04 60/608 |
| 7,703,283 | B2 * | 4/2010 | Barker | F04D 25/028 475/5 |
| 2009/0297337 | A1 | 12/2009 | Hansen et al. | |
| 2014/0161588 | A1 | 6/2014 | Miyata et al. | |
| 2019/0353543 | A1 | 11/2019 | Bygrave | |

FOREIGN PATENT DOCUMENTS

| | | | | | |
|---|---|---|---|---|---|
| EP | 2096332 | A1 * | 9/2009 | | F16H 33/02 |
| GB | 202295 | A * | 6/1924 | | |
| GB | 2321502 | A * | 7/1998 | | F01D 15/12 |
| GB | 2321502 | A | 7/1998 | | |
| JP | 2004324586 | A * | 11/2004 | | |
| JP | 2013-036375 | A | 2/2013 | | |
| JP | 5225660 | B2 * | 7/2013 | | |
| WO | WO-2010009740 | A2 * | 1/2010 | | F01L 1/02 |

* cited by examiner

GEARED COMPRESSOR AND METHOD OF DESIGNING GEARED COMPRESSOR

BACKGROUND OF THE INVENTION

Field of the Invention

The present disclosure relates to a geared compressor and a method of designing the geared compressor. Priority is claimed on Japanese Patent Application No. 2021-014123, filed Feb. 1, 2021, the content of which is incorporated herein by reference.

Description of Related Art

Patent Document 1 (Japanese Unexamined Patent Application, First Publication No. 2013-36375) discloses a geared compressor including a drive gear, a first intermediate gear and a second intermediate gear which mesh with the drive gear, a first driven gear to which the rotation of the drive gear is transmitted through the first intermediate gear, and a second driven gear to which the rotation of the drive gear is transmitted through the second intermediate gear. In Patent Document 1, since the first intermediate gear and the second intermediate gear are provided, the interference between a first-stage compression unit and a second-stage compression unit in accordance with an increase in size of the first-stage compression unit is prevented.

SUMMARY OF THE INVENTION

Incidentally, as the geared compressor, there is known one that drives a plurality of compression units using one large-diameter gear as a drive gear. In the geared compressor that drives the plurality of compression units using one large-diameter gear or the geared compressor described in Patent Document 1, it is desired to increase the capacity of the compression unit.

However, in the case of the geared compressor that drives the plurality of compression units using the large-diameter gear, it is necessary to increase the diameter of the large-diameter gear in order to prevent the interference between the compression units when the compression unit increases in size. As a result, the height of the geared compressor increases. Therefore, the overturning moment of the geared compressor increases, and the maintainability thereof decreases.

Further, in the geared compressor of Patent Document 1, when the number of the driven gears for driving the compression unit is three or more, an intermediate gear needs to be disposed at least above the drive gear and in order to prevent the interference between the compression units, the height also increases. Further, in the geared compressor of Patent Document 1, since the number of the intermediate gears increases, a problem arises in that cost increases due to an increase in the number of components.

The present disclosure has been made to solve the above-described problems and an object of the present disclosure is to provide a geared compressor and a method of designing the geared compressor configured to suppress an increase in height and an increase in cost.

In order to solve the above-described problems, a geared compressor according to the present disclosure includes a plurality of compression units and a compression-unit-driving mechanism which drives the plurality of compression units. The compression-unit-driving mechanism includes a plurality of driven gears which are provided in respective rotation shafts of the plurality of compression units and a plurality of large-diameter gears which are directly or indirectly driven by a drive source and have outer diameters larger than those of the plurality of driven gears. Each of the plurality of large-diameter gears meshes with two or more of the plurality of driven gears.

A method of designing a geared compressor according to the present disclosure is a method of designing the geared compressor as described above and the number of the plurality of large-diameter gears and the outer diameters thereof are determined such that the plurality of compression units are prevented from interfering with each other.

According to the geared compressor and the method of designing the geared compressor of the present disclosure, it is possible to suppress an increase in size and an increase in cost.

DETAILED DESCRIPTION OF THE INVENTION

Hereinafter, a geared compressor and a method of designing the geared compressor according to the present disclosure will be described with reference to the accompanying drawings. However, the present disclosure is not limited to the embodiments.

First Embodiment

Configuration of Geared Compressor

Figure 1:
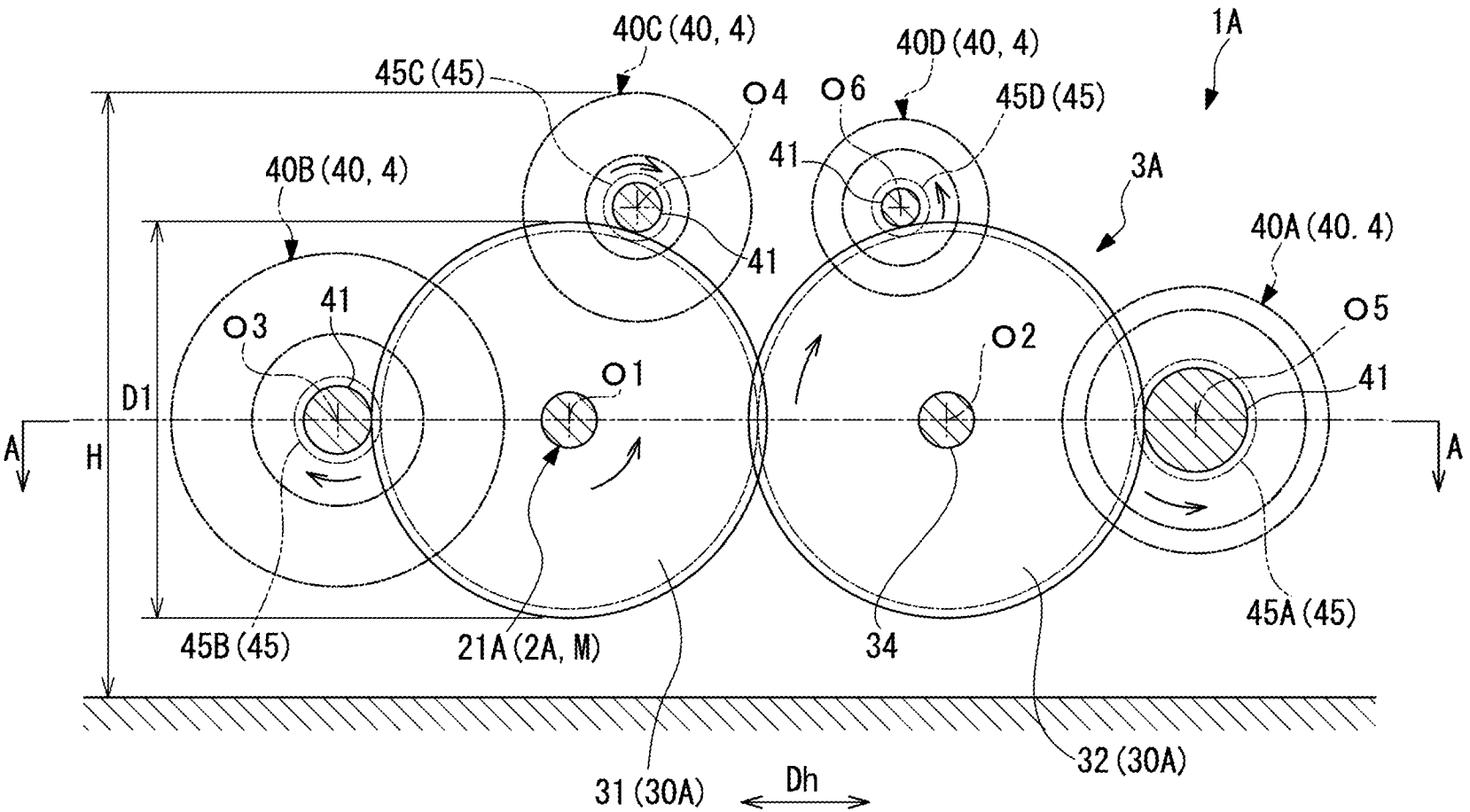
FIG. 1 is a diagram showing a schematic configuration of a geared compressor according to a first embodiment of the present disclosure.
Figure 2:
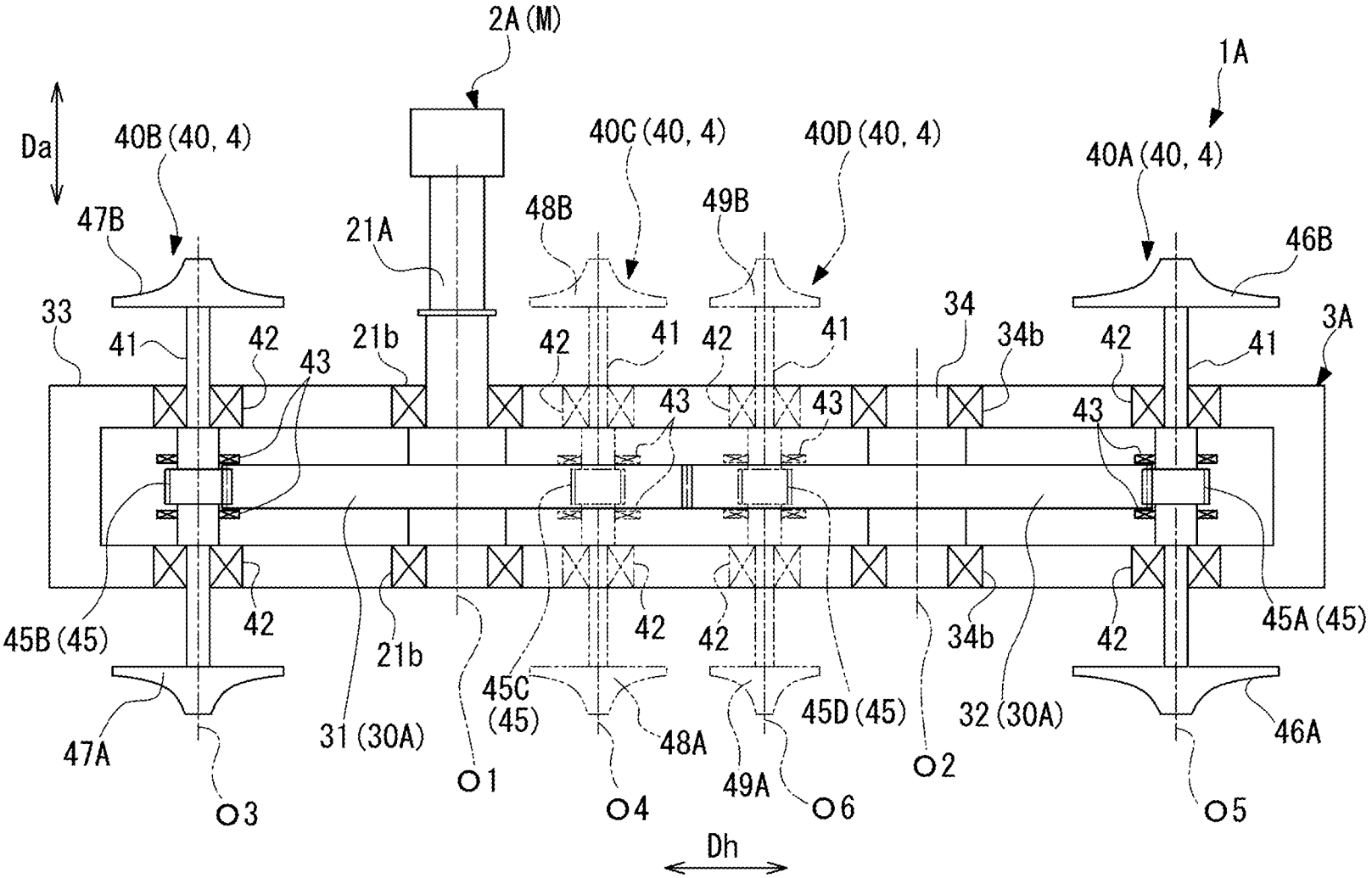
FIG. 2 is a cross-sectional view taken along the line A-A of FIG. 1.

As shown in FIGS. 1 and 2, in a first embodiment, a geared compressor 1A has a multi-axis multi-stage configuration for driving a plurality of impellers. The geared compressor 1A includes a drive source 2A, a compression-unit-driving mechanism 3A, and compression units 40. A plurality of the compression units 40 are provided. In the first embodiment, the geared compressor 1A includes four compression units 40 of a first-stage compression unit 40A, a second-stage compression unit 40B, a third-stage compression unit 40C and a fourth-stage compression unit 40D as the plurality of compression units 40. Additionally, the number of the compression units 40 of the first embodiment is not limited to four.

The drive source 2A generates power for driving the geared compressor 1A. As the drive source 2A, for example, an electric motor M can be used.

The compression-unit-driving mechanism 3A includes a plurality of large-diameter gears 30A and a plurality of driven gears 45 in a gear casing 33 (see FIG. 2). The compression-unit-driving mechanism 3A of the first embodiment includes two large-diameter gears 30A which are arranged side by side, for example, in a first direction Dh which is a predetermined horizontal direction. The large-diameter gear 30A and the driven gear 45 of the first embodiment are both helical gears. The number of teeth of the large-diameter gear 30A is larger than that of the driven gear 45 having the largest number of teeth in the plurality of driven gears 45. Further, the outer diameter of the large-diameter gear 30A is larger than that of the driven gear 45 having the largest outer diameter in the plurality of driven gears 45. The compression-unit-driving mechanism 3A of the first embodiment includes a first drive gear 31 and a first intermediate gear 32 as the plurality of large-diameter gears 30A.

As shown in FIG. 2, the first drive gear 31 is fixed to a drive shaft 21A of the drive source 2A (the electric motor M). The drive shaft 21A extends in an axial direction Da which is perpendicular to the first direction Dh in the horizontal plane. The drive shaft 21A is supported by a gear casing 33 through a pair of bearings 21*b*. The pair of bearings 21*b* supports the drive shaft 21A to be rotatable around a center axis O1 extending in the axial direction Da. In the first embodiment, electric energy is converted into rotation energy by the electric motor M so that the drive shaft 21A of the drive source 2A rotates around the center axis O1. Then, the first drive gear 31 rotates around the center axis O1 together with the drive shaft 21A. In this way, the first drive gear 31 is driven by the electric motor M.

The first intermediate gear 32 is disposed to mesh with the first drive gear 31. The first intermediate gear 32 is fixed to a support shaft 34. The support shaft 34 extends in the axial direction Da in parallel to the drive shaft 21A. The support shaft 34 is supported by the gear casing 33 to be rotatable around a center axis O2 extending in the axial direction Da through a pair of bearings 34*b*. The rotation of the first drive gear 31 driven by the electric motor M is transmitted to the first intermediate gear 32, so that the first intermediate gear 32 rotates around the center axis O2 to follow the rotation of the first drive gear 31. In the first embodiment, the outer diameter and the number of teeth of the first drive gear 31 are the same as the outer diameter and the number of teeth of the first intermediate gear 32.

As shown in FIG. 1 and FIG. 2, each of the first drive gear 31 and the first intermediate gear 32 which are the plurality of large-diameter gears 30A meshes with two or more driven gears 45. In the first embodiment, each of the first drive gear 31 and the first intermediate gear 32 meshes with two driven gears 45 with a gap between the two driven gears 45 in the circumferential direction around the center axes O1 and O2.

A driven gear 45B of the second-stage compression unit 40B and a driven gear 45C of the third-stage compression unit 40C mesh with the first drive gear 31. The driven gear 45B of the second-stage compression unit 40B and the driven gear 45C of the third-stage compression unit 40C follow the rotation of the first drive gear 31 around the center axis O1 to rotate around center axes O3 and O4.

A driven gear 45A of the first-stage compression unit 40A and a driven gear 45D of the fourth-stage compression unit 40D mesh with the first intermediate gear 32. The driven gear 45A of the first-stage compression unit 40A and the driven gear 45D of the fourth-stage compression unit 40D follow the rotation of the first intermediate gear 32 around the center axis O2 to rotate around center axes O5 and O6.

The first-stage compression unit 40A, the second-stage compression unit 40B, the third-stage compression unit 40C and the fourth-stage compression unit 40D are centrifugal compressors and each of them includes a rotation shaft 41. As shown in FIG. 2, the rotation shaft 41 extends in parallel to the drive shaft 21A extending in the axial direction Da. Each driven gear 45 (the driven gears 45A, 45B, 45C and 45D) is fixed to the center portion of the rotation shaft 41 in the axial direction Da. In other words, each rotation shaft 41 extends from the driven gear 45 toward both sides in the axial direction Da.

Each rotation shaft 41 is supported by the gear casing 33 through a pair of bearings 42. These bearings 42 respectively support the rotation shafts 41 to be rotatable around one of the center axes O3 to O6 extending in the axial direction Da. Each rotation shaft 41 includes thrust collars 43. The thrust collars 43 are disposed on both sides of the driven gear 45 in the axial direction Da. The thrust collar 43 is formed to have a diameter larger than that of the driven gear 45. The outer peripheral portion of the thrust collar 43 faces the outer peripheral portion of the large-diameter gear 30A (the first drive gear 31, the first intermediate gear 32) in the axial direction Da and regulates the movement of the rotation shaft 41 in the axial direction Da.

The first-stage compression unit 40A includes first impellers 46A and 46B and a scroll casing (not shown). The scroll casing covers the first impellers 46A and 46B and includes a gas inlet and a gas outlet. The first impellers 46A and 46B are respectively fixed to both ends of the rotation shaft 41 of the first-stage compression unit 40A in the axial direction Da.

The second-stage compression unit 40B includes second impellers 47A and 47B and a scroll casing (not shown). The scroll casing covers the second impellers 47A and 47B and includes a gas inlet and a gas outlet. The second impellers 47A and 47B are respectively fixed to both ends of the rotation shaft 41 of the second-stage compression unit 40B in the axial direction Da.

The third-stage compression unit 40C includes third impellers 48A and 48B and a scroll casing (not shown). The scroll casing covers the third impellers 48A and 48B and includes a gas inlet and a gas outlet. The third impellers 48A and 48B are respectively fixed to both ends of the rotation shaft 41 of the third-stage compression unit 40C in the axial direction Da.

The fourth-stage compression unit 40D includes fourth impellers 49A and 49B and a scroll casing (not shown). The scroll casing covers the fourth impellers 49A and 49B and includes a gas inlet and a gas outlet. The fourth impellers 49A and 49B are respectively fixed to both ends of the rotation shaft 41 of the fourth-stage compression unit 40D in the axial direction Da.

In any of the first impellers 46A and 46B, the second impellers 47A and 47B, the third impellers 48A and 48B and the fourth impellers 49A and 49B, a working fluid sucked from the gas inlet into the scroll casing is compressed while being sent to the outer peripheral side in the radial direction through a flow path formed therein. The first-stage compression unit 40A, the second-stage compression unit 40B, the third-stage compression unit 40C and the fourth-stage compression unit 40D are connected through pipes (not shown). Accordingly, in the geared compressor 1A, the working fluid is compressed in stages while sequentially passing through the first-stage compression unit 40A, the second-stage compression unit 40B, the third-stage compression unit 40C and the fourth-stage compression unit 40D.

As described above, in the geared compressor 1A of the first embodiment, the plurality of driven gears 45 are rotated by the plurality of large-diameter gears 30A. Next, a comparison is made between the geared compressor 1A having the above-described configuration and the configuration in which the plurality of driven gears 145 are rotated by one large-diameter gear 130 as shown in FIG. 3.

When the plurality of driven gears 145 are rotated by one large-diameter gear 130, an outer diameter D2 of the large-diameter gear 130 increases in accordance with the capacity of the compression unit 140 when trying to avoid the interference between the compression units 140. In contrast, in the geared compressor 1A of the first embodiment, outer diameters D1 (see FIG. 1) of the plurality of large-diameter gears 30A can be made smaller than the outer diameter D2 of one large-diameter gear 130 while avoiding the interference between the compression units 40 in the first direction Dh. Thus, it is possible to keep the height H of the geared compressor 1A including the compression-unit-driving mechanism 3A low as shown in FIG. 1. Further, in the geared compressor 1A, since the plurality of large-diameter gears 30A are arranged side by side in the first direction Dh, the width of the compression-unit-driving mechanism 3A in the first direction Dh increases. However, a space below the plurality of compression units 40 can be effectively used as, for example, a space in which a peripheral device such as a gas cooler is disposed.

Figure 3:
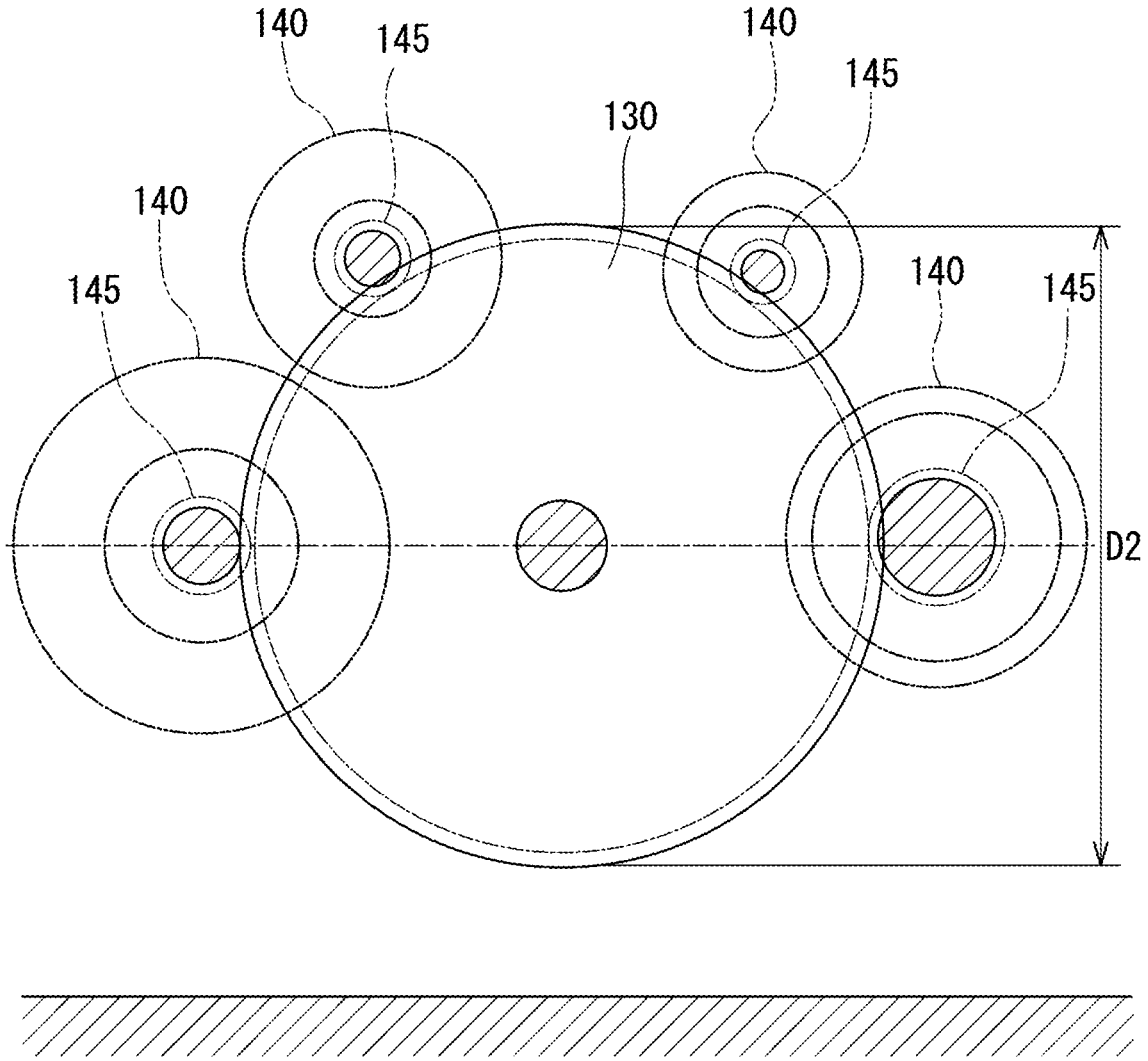
FIG. 3 is a diagram showing an example of a compression-unit-driving mechanism to be compared with a compression-unit-driving mechanism according to the first embodiment of the present disclosure.

On the other hand, when one large-diameter gear 130 shown in FIG. 3 is used, high strength is required for the teeth constituting the large-diameter gear 130 when rotating the large-diameter gear 130 at a high speed. Therefore, the circumferential speed of the large-diameter gear 130 needs to be smaller than a predetermined upper-limit circumferential speed (for example, smaller than 140 m/s). Therefore, for example, a large-sized motor which rotates at a low speed of 1000 to 1200 rpm and can rotate the large-diameter gear 130 needs to be used as the electric motor M rotating the large-sized large-diameter gear 130. Such a large-sized electric motor M enabling low-speed rotation becomes an expensive one such as a 6-pole motor.

In contrast, when the outer diameter D1 of the large-diameter gear 30A is made small as in the geared compressor 1A of the first embodiment, the rotation speed of the electric motor M rotating the large-diameter gear 30A can be increased to, for example, 1500 to 1800 rpm. Therefore, in the geared compressor 1A, a cheaper 4-pole motor or the like can be used as the electric motor M.

The outer diameter D1 of the large-diameter gear 30A (the first drive gear 31, the first intermediate gear 32) may be equal to or smaller than a predetermined upper-limit outer diameter (for example, 1.8 m). Here, it is difficult to manufacture the thrust collar 43 when the outer diameter D1 of the large-diameter gear 30A exceeds the upper-limit outer diameter. In other words, it is possible to adopt the thrust collar 43 by suppressing the outer diameter D1 of the large-diameter gear 30A to be equal to or smaller than the upper-limit outer diameter. The thrust collar 43 is fixed to the rotation shaft 41 and is in sliding contact with the outer peripheral portion of the large-diameter gear 30A. Therefore, the thrust collar 43 has a small mechanical loss compared to a thrust bearing provided with a thrust disk that is in sliding contact with a sliding pad that is a stationary body.

That is, when the plurality of large-diameter gears 30A are provided as in the geared compressor 1A, the outer diameter D1 can be equal to or smaller than the upper-limit outer diameter while providing the same compression unit 40 as when the large-diameter gear 130 having the outer diameter D2 exceeding the upper-limit outer diameter is provided. Accordingly, it is possible to reduce a mechanical loss by using the thrust collar 43.

Method of Designing Compression-Unit-Driving Mechanism

Figure 4:
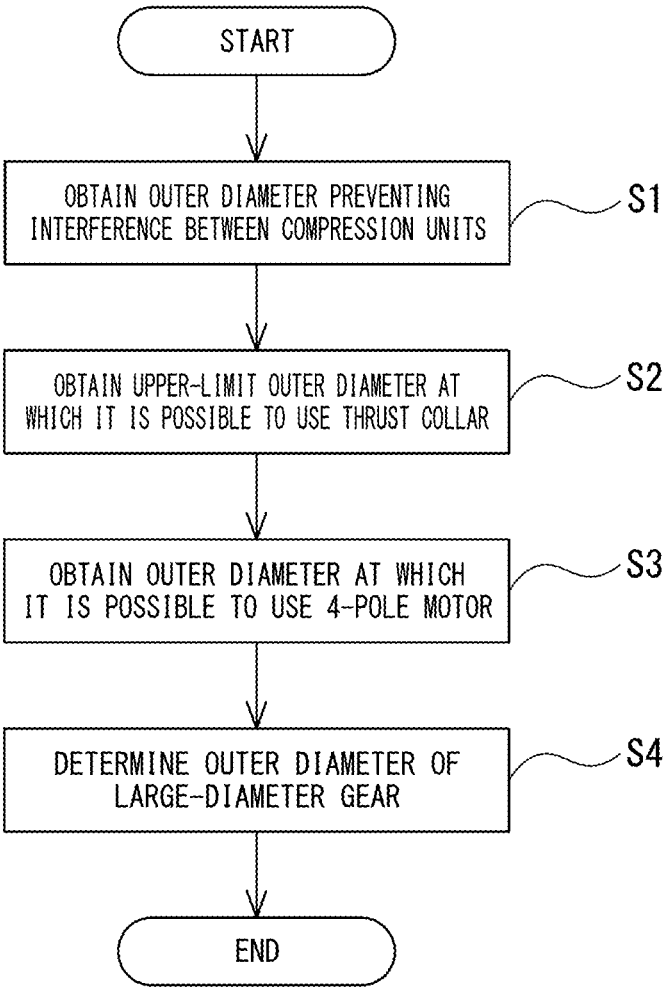
FIG. 4 is a flowchart showing a procedure of a method of designing a geared compressor according to the embodiment of the present disclosure.

Next, a method of designing the geared compressor 1A will be described. As shown in FIG. 4, a method S1 of designing the geared compressor 1A of the first embodiment includes step S2, step S3 and step S4.

In the method S1 of designing the geared compressor 1A, the number of teeth of the plurality of large-diameter gears 30A and the outer diameters D1 thereof are determined such that the plurality of compression units 40 are prevented from interfering with each other in the geared compressor 1A. Here, the number of teeth of the large-diameter gear 30A is determined by the outer diameter D1 of the large-diameter gear 30A and the pitch of teeth. The number of teeth of the plurality of driven gears 45 (the driven gears 45A, 45B, 45C and 45D) can be obtained based on the number of teeth of the large-diameter gear 30A, the rotation speed of the drive shaft 21A at which the drive shaft 21A is normally operated by the electric motor M and the set value of the rotation speed necessary when operating the first-stage compression unit 40A, the second-stage compression unit 40B, the third-stage compression unit 40C and the fourth-stage compression unit 40D.

In step S2, a predetermined upper-limit outer diameter of the outer diameter D1 of the large-diameter gear 30A at which the large-diameter gear 30A is configured to receive a thrust force acting on the rotation shaft 41 using the thrust collar 43 is obtained. When the outer diameter D1 exceeds the predetermined upper-limit outer diameter, the thrust collar 43 cannot be used due to the above-described manufacturing reasons. That is, when the outer diameter D1 of the large-diameter gear 30A is made equal to or smaller than the upper-limit outer diameter in step S2, it is possible to use the thrust collar 43 having a lower loss.

In step S3, the outer diameter D1 at which it is possible to use a 4-pole motor as the electric motor M is obtained. More specifically, in step S3, the lower-limit rotation speed of the 4-pole motor at which the 4-pole motor can be normally operated is obtained and the outer diameter D1 which does not exceed the upper-limit circumferential speed of the large-diameter gear 30A when the rotation speed of the 4-pole motor is the lower-limit rotation speed is obtained. As described above, the upper-limit circumferential speed is determined based on the strength and the like of the teeth of the large-diameter gear 30A. When the rotation speed of the electric motor M is constant, the circumferential speed of the large-diameter gear 30A becomes higher as the outer diameter D1 becomes larger. That is, if the outer diameter D1 which allows the rotation of the large-diameter gear 30A at the upper-limit circumferential speed when the rotation speed of the electric motor M is the lower-limit rotation speed is set as the upper-limit outer diameter and the outer diameter D1 of the large-diameter gear 30A is equal to the upper-limit outer diameter or less, the electric motor M can be operated at the lower-limit rotation speed or more. That is, step S3 eliminates the need to use a 6-pole motor which can be used in a lower speed rotation region than the 4-pole motor and makes it possible to use a 4-pole motor which is cheaper than the 6-pole motor.

In step S4, the outer diameter D1 of the large-diameter gear 30A is determined as the outer diameter D1 which satisfies all of the condition of the outer diameter D1 preventing the interference between the compression units 40, the condition of the upper-limit outer diameter obtained in step S2 and the condition of the outer diameter D1 obtained in step S3.

Additionally, steps S2 and S3 described above may be performed if necessary. For example, only step S2 may be performed, only step S3 may be performed, or neither step S2 nor step S3 may be performed.

Operation and Effect

The geared compressor 1A with the above-described configuration includes the plurality of large-diameter gears 30A which are directly or indirectly driven by the drive source 2A and have the outer diameter and the number of teeth larger than those of the plurality of driven gears 45. The plurality of large-diameter gears 30A are arranged side by side in the horizontal direction. Further, each of the plurality of large-diameter gears 30A meshes with two or more driven gears 45.

Therefore, the driving force of the drive source 2A can be transmitted to the plurality of compression units 40 through the plurality of large-diameter gears 30A and the plurality of driven gears 45.

Then, since each of the plurality of large-diameter gears 30A meshes with two or more driven gears 45, it is possible to suppress an increase in the number of gears constituting the compression-unit-driving mechanism 3A and to suppress an increase in cost due to the increase in the number of components of the geared compressor 1A.

Further, since it is possible to decrease the outer diameters of the large-diameter gears 30A arranged side by side in the first direction Dh which is the horizontal direction compared to the case of using one large-diameter gear 130 (see FIG. 3), it is possible to suppress an increase in height of the geared compressor 1A and to suppress an increase in the overturning moment of the geared compressor 1A and a decrease in the maintainability thereof.

Further, since the plurality of large-diameter gears 30A are arranged side by side in the horizontal direction, it is possible to easily make the plurality of large-diameter gears 30A mesh with each other. Further, the width of the geared compressor 1A in the first direction Dh increases, but a space below the plurality of compression units 40 can be effectively used as, for example, a space in which a peripheral device such as a gas cooler is disposed.

The geared compressor 1A with the above-described configuration further includes the first drive gear 31 and the first intermediate gear 32 as the plurality of large-diameter gears 30A.

According to such a configuration, the first drive gear 31 is directly driven by the drive source 2A and the first intermediate gear 32 is indirectly driven through the first drive gear 31. Then, the plurality of driven gears 45 meshing with the first drive gear 31 and the plurality of driven gears 45 meshing with the first intermediate gear 32 are respectively driven through the first drive gear 31 and the first intermediate gear 32. That is, in the geared compressor 1A, since the plurality of driven gears 45 mesh with not only the first intermediate gear 32 but also the first drive gear 31, it is possible to decrease the number of the intermediate gears compared to the case in which the driven gear 45 meshes with only the intermediate gear. As a result, it is possible to decrease the number of components of the geared compressor 1A.

Further, in the geared compressor 1A with the above-described configuration, the plurality of large-diameter gears 30A have the same outer diameter D1. Therefore, the circumferential speeds of the plurality of large-diameter gears 30A can be made uniform and an increase in diameter of only part of the plurality of large-diameter gears 30A can be suppressed. Thus, it is possible to effectively suppress the height of the geared compressor 1A.

Further, according to the method S1 of designing the geared compressor 1A with the above-described configuration, it is possible to design the geared compressor 1A that suppresses the height and cost compared to the case of using one large-diameter gear 130.

Second Embodiment

Next, a second embodiment of a compression-unit-driving mechanism according to the present disclosure will be described. In the second embodiment which will be described below, the configuration which is common to the first embodiment is designated by the same reference numeral and the description is omitted. The second embodiment is different from the first embodiment in that a drive gear 25 is provided. Additionally, since a method of designing a geared compressor 1B of the second embodiment is the same as the method of designing the geared compressor 1A of the first embodiment, the description is omitted.

Configuration of Geared Compressor

Figure 5:
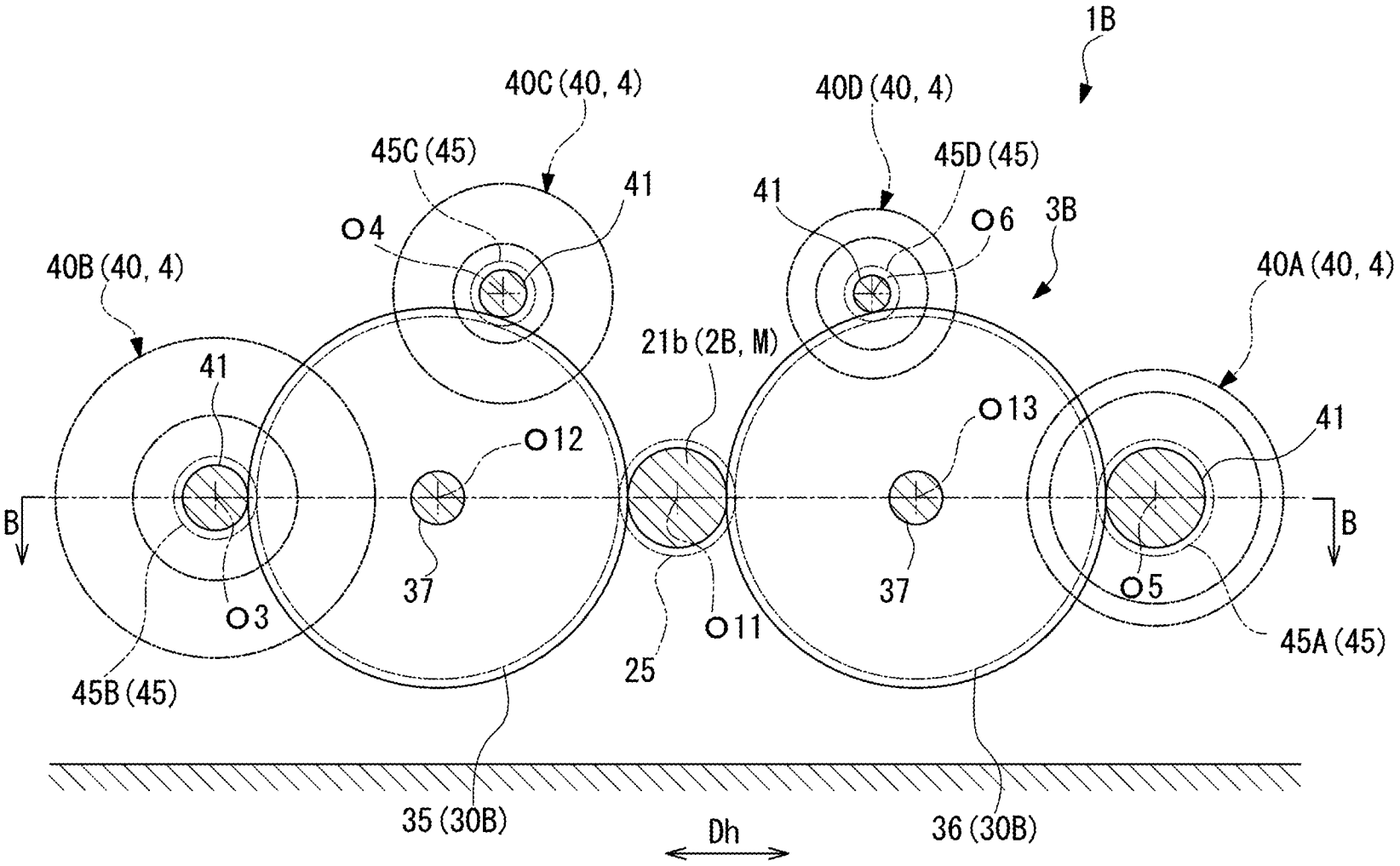
FIG. 5 is a diagram showing a schematic configuration of a geared compressor according to a second embodiment of the present disclosure.
Figure 6:
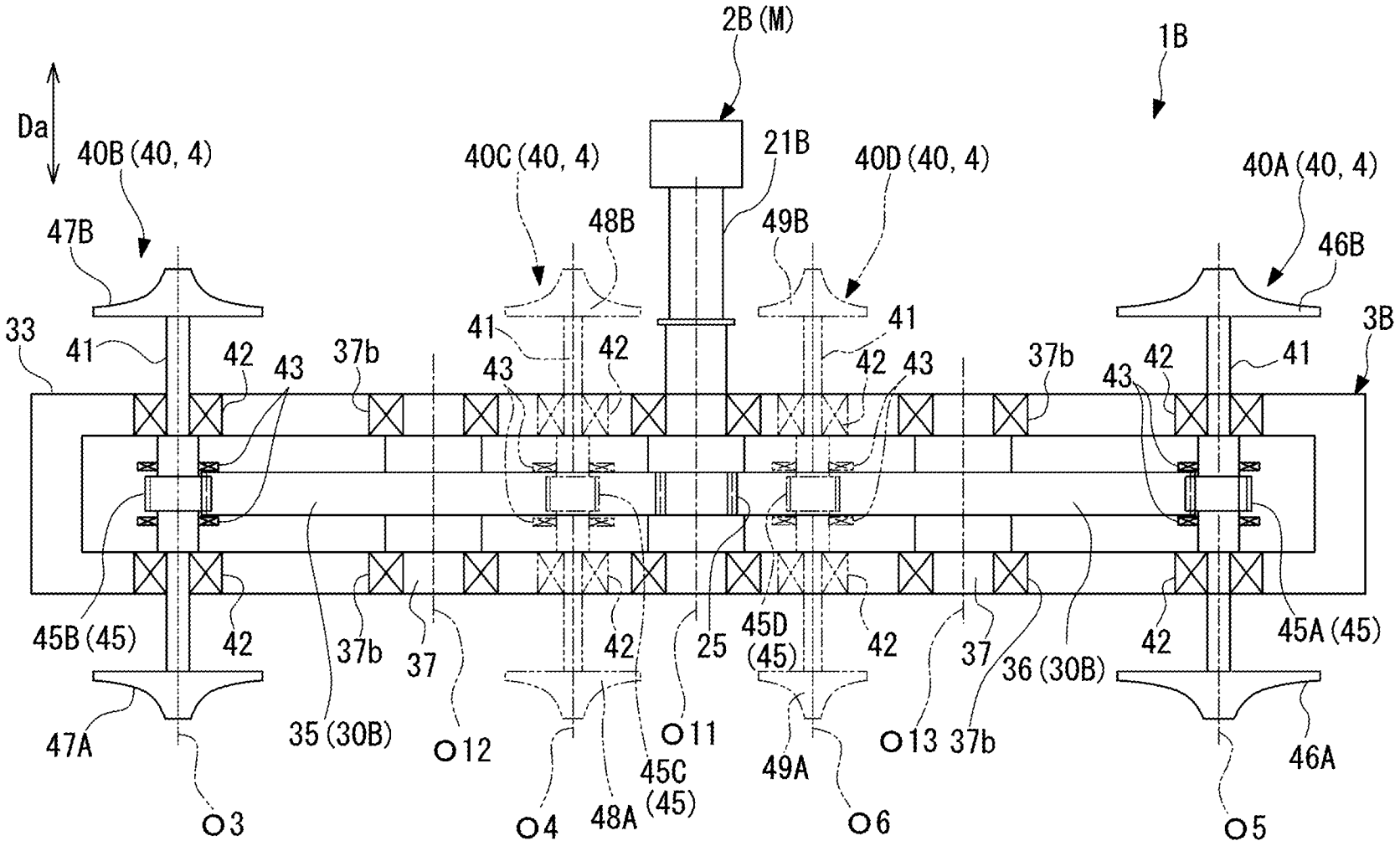
FIG. 6 is a cross-sectional view taken along the line B-B of FIG. 5.

As shown in FIGS. 5 and 6, in the second embodiment, the geared compressor 1B includes a drive source 2B, a compression-unit-driving mechanism 3B, and a compression unit 40.

The compression-unit-driving mechanism 3B includes the drive gear 25, a plurality of large-diameter gears 30B and the plurality of driven gears 45 in the gear casing 33.

The drive gear 25 is fixed to the drive shaft 21B of the drive source 2B (the electric motor M). The drive shaft 21B extends in the axial direction Da. The drive shaft 21B is supported by the gear casing 33 through a pair of bearings 21*b*. The pair of bearings 21*b* supports the drive shaft 21B to be rotatable around a center axis O11 extending in the axial direction Da. The drive gear 25 rotates around the center axis O11 together with the drive shaft 21B by the operation of the electric motor M. In this way, the drive gear 25 is driven by the electric motor M.

All of the drive gear 25, the plurality of large-diameter gears 30B and the plurality of driven gears 45 are helical gears. The numbers of teeth of the plurality of large-diameter gears 30B are larger than that of the driven gear 45 having the largest number of teeth in the plurality of driven gears 45. Further, the outer diameters of the plurality of large-diameter gears 30A are larger than that of the driven gear 45 having the largest outer diameter in the plurality of driven gears 45. The compression-unit-driving mechanism 3B of the second embodiment includes a second intermediate gear 35 and a third intermediate gear 36 as the plurality of large-diameter gears 30B. In the second embodiment, the second intermediate gear 35 and the third intermediate gear 36 are arranged side by side in the first direction Dh. The second intermediate gear 35 and the third intermediate gear 36 are respectively arranged on both sides of the drive gear 25 in the first direction Dh. The second intermediate gear 35 and the third intermediate gear 36 are arranged to mesh with the drive gear 25.

Each of the second intermediate gear 35 and the third intermediate gear 36 is fixed to the support shaft 37. The support shafts 37 extend in parallel to the axial direction Da, that is, the drive shaft 21B. The support shafts 37 are supported by the gear casing 33 to be rotatable around center axes O12 and O13 extending in the axial direction Da respectively through a pair of bearings 37*b*. The second intermediate gear 35 and the third intermediate gear 36 follow the rotation of the drive gear 25 to rotate around the center axes O12 and O13. In this way, the second intermediate gear 35 and the third intermediate gear 36 are indirectly driven by the drive source 2B. In the second embodiment, the second intermediate gear 35 and the third intermediate gear 36 have the same number of teeth and the same outer diameter.

Each of the second intermediate gear 35 and the third intermediate gear 36 which are the plurality of large-diameter gears 30B meshes with two or more driven gears 45. In the second embodiment, two driven gears 45 mesh with the second intermediate gear 35 with a gap between the two driven gears 45 in the circumferential direction around the center axis O12. Similarly, two driven gears 45 mesh with the third intermediate gear 36 with a gap between the two driven gears 45 in the circumferential direction around the center axis O13.

The driven gear 45B of the second-stage compression unit 40B and the driven gear 45C of the third-stage compression unit 40C mesh with the second intermediate gear 35 of the second embodiment. The driven gear 45B of the second-stage compression unit 40B and the driven gear 45C of the third-stage compression unit 40C follow the rotation of the second intermediate gear 35 around the center axis O12 to rotate around the center axes O3 and O4. The driven gear 45A of the first-stage compression unit 40A and the driven gear 45D of the fourth-stage compression unit 40D mesh with the third intermediate gear 36 of the second embodiment. The driven gear 45A of the first-stage compression unit 40A and the driven gear 45D of the fourth-stage compression unit 40D follow the rotation of the third intermediate gear 36 around the center axis O13 to rotate around the center axes O5 and O6.

Operation and Effect

The compression-unit-driving mechanism 3B of the geared compressor 1B with the above-described configuration includes the plurality of large-diameter gears 30B which are indirectly driven by the drive source 2B and in which the outer diameter and the number of teeth thereof are larger than those of the plurality of driven gears 45. Each of the plurality of large-diameter gears 30B meshes with two or more driven gears 45.

Therefore, it is possible to suppress an increase in the number of the large-diameter gears 30B compared to the case in which one driven gear 45 meshes with one large-diameter gear 30B. Thus, it is possible to suppress an increase in the number of gears constituting the compression-unit-driving mechanism 3B and to suppress an increase in cost due to the increase in the number of components of the geared compressor 1B.

Further, since it is possible to decrease the outer diameters of the large-diameter gears 30B arranged side by side in the first direction Dh which is the horizontal direction compared to the case of using one large-diameter gear 130 (see FIG. 3), it is possible to suppress an increase in height of the geared compressor 1B and to suppress an increase in the overturning moment of the geared compressor 1B and a decrease in the maintainability thereof.

Further, the geared compressor 1B includes the second intermediate gear 35 and the third intermediate gear 36 as the plurality of large-diameter gears 30B which mesh with the drive gear 25.

Accordingly, for example, even when the outer diameter of the drive gear 25 cannot be increased, the plurality of driven gears 45 can be driven through the second intermediate gear 35 and the third intermediate gear 36. Accordingly, it is possible to suppress an increase in size of the geared compressor 1B and an increase in cost thereof similarly to the first embodiment.

Other Embodiments

Although the embodiments of the present disclosure have been described above with reference to the drawings, the detailed configuration is not limited to the embodiments and design changes and the like within the scope not departing from the concept of the present disclosure are also included.

Additionally, in the above-described first and second embodiments, the electric motor M is used as the drive source 2A, but the present disclosure is not limited thereto. For example, a steam turbine or the like may be used as the drive source 2A.

Further, in the above-described first and second embodiments, each of the large-diameter gears 30A and 30B is arranged to mesh with two driven gears 45, but the present disclosure is not limited thereto. For example, three or more large-diameter gears 30A and 30B may be provided. Further, each of the large-diameter gears 30A and 30B may be arranged to mesh with three or more driven gears.

Further, in the above-described first and second embodiments, the impellers are provided at both ends of the rotation shaft 41 in the axial direction Da provided with the driven gear 45, but the impeller may be provided only at one end of the rotation shaft 41 in the axial direction Da.

Further, in the above-described first and second embodiments, the first-stage compression unit 40A, the second-stage compression unit 40B, the third-stage compression unit 40C and the fourth-stage compression unit 40D which are the centrifugal compressors are provided as the plurality of compression units 40, but a compression unit other than the centrifugal compressor may be provided.

Appendix

The geared compressors 1A and 1B and the method of designing the geared compressors 1A and 1B of the embodiments are understood, for example, as below.

(1) The geared compressors 1A and 1B according to a first aspect include the plurality of compression units 40 and the compression-unit-driving mechanisms 3A and 3B which drive the plurality of compression units, the compression-unit-driving mechanisms 3A and 3B include the plurality of driven gears 45 which are fixed to the respective rotation shafts 41 of the plurality of compression units 40 and the plurality of large-diameter gears 30A and 30B which are directly or indirectly driven by the drive sources 2A and 2B and have outer diameters larger than those of the plurality of driven gears 45, the plurality of large-diameter gears 30A and 30B are arranged side by side in the horizontal direction Dh, and each of the plurality of large-diameter gears meshes with two or more of the plurality of driven gears 45.

Examples of the compression unit 40 include a centrifugal compressor.

Examples of the drive sources 2A and 2B include an electric motor and a steam turbine.

In the geared compressors 1A and 1B, since the plurality of large-diameter gears 30A and 30B have outer diameters larger than those of the plurality of driven gears 45 and each of the plurality of large-diameter gears 30A and 30B is arranged to mesh with two or more driven gears 45, it is possible to suppress an increase in the number of gears constituting the geared compressors 1A and 1B. Thus, it is possible to suppress an increase in cost of the geared compressors 1A and 1B. Further, since it is possible to decrease the outer diameters of the large-diameter gears 30A and 30B arranged side by side in the first direction which is the horizontal direction compared to the case of using only one large-diameter gear, it is possible to suppress an increase in height of the geared compressors 1A and 1B and to suppress an increase in the overturning moment of the geared compressors 1A and 1B and a decrease in the maintainability thereof. Further, since the plurality of large-diameter gears 30A and 30B are arranged side by side in the horizontal direction, the width of the geared compressors 1A and 1B in the horizontal direction Dh increases. However, a space below the plurality of compression units 40 can be effectively used as, for example, a space in which a peripheral device such as a gas cooler is disposed.

(2) The geared compressor 1A according to a second aspect is the geared compressor 1A of (1) and the plurality of large-diameter gears 30A include the first drive gear 31 fixed to the drive shaft 21A of the drive source 2A and the first intermediate gear 32 which meshes with the first drive gear 31.

Accordingly, the first drive gear 31 is directly driven by the drive source 2A and the first intermediate gear 32 is indirectly driven by the drive source 2A through the first drive gear 31. The plurality of driven gears 45 meshing with the first drive gear 31 and the plurality of driven gears 45 meshing with the first intermediate gear 32 are respectively driven through the first drive gear 31 and the first intermediate gear 32. That is, in the geared compressor 1A, since not only the first intermediate gear 32 but also the first drive gear 31 meshes with the plurality of driven gears 45, it is possible to decrease the number of the intermediate gears compared to the case in which the driven gear 45 meshes with only the intermediate gear. As a result, it is possible to decrease the number of components of the geared compressor 1A.

(3) The geared compressor 1B of a third aspect is the geared compressor 1B of (1) and further includes the drive gear 25 fixed to the drive shaft 21B of the drive source 2B and the plurality of large-diameter gears 30B include the second intermediate gear 35 which meshes with the drive gear 25 and the third intermediate gear 36 which meshes with the drive gear 25 at a position different from that of the second intermediate gear 35.

Accordingly, the driving force of the drive source 2B is transmitted to the second intermediate gear 35 and the third intermediate gear 36 through the drive gear 25. Therefore, for example, even when the outer diameter of the drive gear 25 cannot be increased, it is possible to drive the plurality of driven gears 45 through the second intermediate gear 35 and to drive the plurality of driven gears 45 through the third intermediate gear 36. Thus, it is possible to suppress an increase in size of the geared compressor 1B and to suppress an increase in cost thereof.

(4) The geared compressors 1A and 1B of a fourth aspect are the geared compressors 1A and 1B according to any one of (1) to (3) and the plurality of large-diameter gears 30A and 30B have the same number of teeth.

Accordingly, since the plurality of large-diameter gears 30A have the same outer diameter D1, the circumferential speeds of the plurality of large-diameter gears 30A can be made uniform. Further, it is possible to suppress an increase in diameter of only part of the plurality of large-diameter gears 30A. Thus, it is possible to effectively suppress the heights of the geared compressors 1A and 1B.

(5) The method S1 of designing the geared compressors 1A and 1B according to a fifth aspect is the method S1 of designing the geared compressors 1A and 1B of any one of (1) to (4) and the number and the outer diameters of the plurality of large-diameter gears 30A and 30B are determined such that the plurality of compression units 40 are prevented from interfering with each other.

Accordingly, it is possible to decrease the heights of the large-diameter gears 30A and 30B compared to the case of driving the plurality of compression units 40 by using only one large-diameter gear. Thus, it is possible to design the geared compressors 1A and 1B configured to suppress an increase in size and an increase in cost.

(6) The method S1 of designing the geared compressors 1A and 1B according to a sixth aspect is the method S1 of designing the geared compressors 1A and 1B of (5) and, when the outer diameters of the plurality of large-diameter gears are determined, the outer diameters of the plurality of large-diameter gears 30A and 30B are determined to be a predetermined upper-limit outer diameter or less at which the plurality of large-diameter gears are configured to receive a thrust force of the rotation shaft using the thrust collar.

Accordingly, since it is possible to use the thrust collar, it is possible to suppress mechanical loss and a generation of vibration compared to the case of receiving a thrust force using a thrust disk in which a rotation body contacts a stationary body.

(7) The method S1 of designing the geared compressors 1A and 1B according to a seventh aspect is the method S1 of designing the geared compressors 1A and 1B of (5) or (6), the drive source 2A is a 4-pole motor, and, when the outer diameters of the plurality of large-diameter gears 30A and 30B are determined, the outer diameters of the large-diameter gears 30A and 30B are determined such that the circumferential speeds of the large-diameter gears 30A and 30B are smaller than a predetermined upper-limit circumferential speed and a rotation speed of the 4-pole motor is equal to or larger than a lower-limit rotation speed at which the 4-pole motor is normally operated.

Accordingly, since the circumferential speeds of the large-diameter gears 30A and 30B can be smaller than the upper-limit circumferential speed even when a cheaper 4-pole motor is used as the drive source 2A, it is possible to decrease the cost of the geared compressors 1A and 1B.

EXPLANATION OF REFERENCES

1A, 1B Geared compressor
2A, 2B Drive source
3A, 3B Compression-unit-driving mechanism
21A, 21B Drive shaft
21*b* Bearing
25 Drive gear
30A, 30B Large-diameter gear
31 First drive gear
32 First intermediate gear
33 Gear casing

34 Support shaft
34*b* Bearing
35 Second intermediate gear
36 Third intermediate gear
37 Support shaft
37*b* Bearing
40 Compression unit
40A First-stage compression unit
40B Second-stage compression unit
40C Third-stage compression unit
40D Fourth-stage compression unit
41 Rotation shaft
42 Bearing
43 Thrust collar
45, 45A, 45B, 45C, 45D Driven gear
46A, 46B First impeller
47A, 47B Second impeller
48A, 48B Third impeller
49A, 49B Fourth impeller
130 Large-diameter gear
140 Compression unit
145 Driven gear
Da Axial direction
Dh First direction
D1, D2 Outer diameter
H Height
M Electric motor
O1, O2, O3, O4, O5, O11, O12, O13 Center axis

What is claimed is:

1. A geared compressor comprising:
a plurality of compression units; and
a compression-unit-driving mechanism which drives the plurality of compression units,
wherein the compression-unit-driving mechanism includes
a plurality of driven gears which are fixed to respective rotation shafts of the plurality of compression units, and
a plurality of large-diameter gears which are directly or indirectly driven by a drive source and have outer diameters larger than those of the plurality of driven gears, and
wherein the plurality of large-diameter gears is arranged side by side in a horizontal direction and each of the plurality of large-diameter gears meshes with two or more of the plurality of driven gears.

2. The geared compressor according to claim 1,
wherein the plurality of large-diameter gears includes
a first drive gear fixed to a drive shaft of the drive source, and
a first intermediate gear which meshes with the first drive gear.

3. The geared compressor according to claim 1, further comprising:
a drive gear fixed to a drive shaft of the drive source,
wherein the plurality of large-diameter gears includes
a second intermediate gear which meshes with the drive gear, and
a third intermediate gear which meshes with the drive gear at a position different from that of the second intermediate gear.

4. The geared compressor according to claim 1,
wherein the plurality of large-diameter gears has the same number of teeth.

5. A method of designing a geared compressor, the geared compressor being according to claim 1,
wherein the number of the plurality of large-diameter gears and the outer diameters thereof are determined such that the plurality of compression units is prevented from interfering with each other.

6. The method of designing the geared compressor according to claim 5,
wherein, when the outer diameters of the plurality of large-diameter gears are determined, the outer diameters of the plurality of large-diameter gears are determined to be a predetermined upper-limit outer diameter or less at which the plurality of large-diameter gears are configured to receive a thrust force of the rotation shaft using a thrust collar.

7. The method of designing the geared compressor according to claim 5,
wherein the drive source is a 4-pole motor, and
wherein, when the outer diameters of the plurality of large-diameter gears are determined, the outer diameters of the plurality of large-diameter gears are determined such that circumferential speeds of the plurality of large-diameter gears are smaller than a predetermined upper-limit circumferential speed and a rotation speed of the 4-pole motor is equal to or larger than a lower-limit rotation speed at which the 4-pole motor is normally operated.

* * * * *